US007972162B2

(12) United States Patent
Hsu

(10) Patent No.: US 7,972,162 B2
(45) Date of Patent: Jul. 5, 2011

(54) SOCKET WITH FIXING EQUIPMENT

(75) Inventor: Shuo-Hsiu Hsu, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 25 days.

(21) Appl. No.: 12/549,401

(22) Filed: Aug. 28, 2009

(65) Prior Publication Data

US 2010/0055939 A1 Mar. 4, 2010

(30) Foreign Application Priority Data

Sep. 1, 2008 (TW) ..... 97215669 U

(51) Int. Cl.
*H01R 13/62* (2006.01)

(52) U.S. Cl. ..... 439/326

(58) Field of Classification Search ..... 439/326, 439/630

See application file for complete search history.

(56) References Cited

U.S. PATENT DOCUMENTS

| | | | | |
|---|---|---|---|---|
| 5,813,878 | A * | 9/1998 | Kuwata et al. | 439/326 |
| 6,334,786 | B1 * | 1/2002 | Lee | 439/331 |
| 6,890,203 | B2 | 5/2005 | Matsunaga et al. | |
| 2004/0087211 | A1 * | 5/2004 | Harasawa et al. | 439/630 |
| 2007/0093137 | A1 * | 4/2007 | Zhao et al. | 439/630 |

* cited by examiner

*Primary Examiner* — Ross N Gushi

(74) *Attorney, Agent, or Firm* — Andrew C. Cheng; Wei Te Chung; Ming Chieh Chang

(57) ABSTRACT

A socket, adapted for electrically connecting an IC package to a printed circuit board, comprises an insulative housing accommodating a plurality of contacts and a cover pivotally assembled on an end of the insulative housing. The insulative housing has two lateral sides and a base portion disposed between the lateral sides, and each lateral side is formed with two incepting portions on two opposite ends thereof. The cover has two fixing portions extending downwardly from two sides thereof and corresponding to the incepting portions of the insulative housing. When the cover rotates to a close position, the fixing portion of the cover directly latches the incepting portion of the insulative housing to prevent the cover from tilting.

17 Claims, 5 Drawing Sheets

SOCKET WITH FIXING EQUIPMENT

BACKGROUND OF THE INVENTION

1. Field of the Invention

The present invention relates to a socket for electrically connecting a module to a printed circuit board.

2. Description of the Related Art

A related socket adapted for electrically connecting an IC package to a printed circuit board is disclosed in U.S. Pat. No. 6,890,203, issued to Akihiro Matsunaga et al. on May 10, 2005. Referring to FIG. 1 and FIG. 2 of this patent, the socket has an insulative housing and a cover pivotally assembled to the insulative housing, the insulative housing receives a plurality of contacts received therein for conducting with the IC package mounted upon the insulative housing. The insulative housing is formed with two pivots oppositely and laterally extending from an end thereof, the cover correspondingly provides a pivot hole engaging with the pivot. The insulative housing has two protrusions oppositely and laterally protruding from an opposite end thereof, the cover correspondingly forms a receiving portion engaging with the protrusion. The IC package is sandwiched between the insulating housing and the cover to electrically connect with the printed circuit board.

However, when the cover presses the IC package against the insulative housing, the IC package exerts an upward force on the cover, the pivot formed on the insulating housing may be frayed after repetitively using since the insulative housing is formed by plastic while the cover is formed by metal, that may cause one pivot tilt and influence a connection between the IC package and the printed circuit board.

Hence, it is required to improve the disadvantages of the above socket.

SUMMARY OF THE INVENTION

An object of the invention is to provide a socket, which can prevent a cover thereof from titling.

To achieve the above-mentioned object, a socket, for electrically connecting a module to a printed circuit board, comprises an insulative housing, a plurality of contacts received within the base portion of the insulative housing and a cover pivotally assembled to the insulative housing. The insulative housing has a base portion and two lateral sides disposed on two sides of the base portion, and each lateral side has at least two incepting portions recessed from a vertical outside surface of the lateral side. The cover is rotatable between an open position and a close position and is formed with a main body covering the insulating housing and a plurality of fixing portions disposed on two sides of the main body. Wherein when the cover rotates downwardly to the close position, the fixing portions of the cover directly latch with the inception portions of the insulative housing to latch the cover and the insulative housing together.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
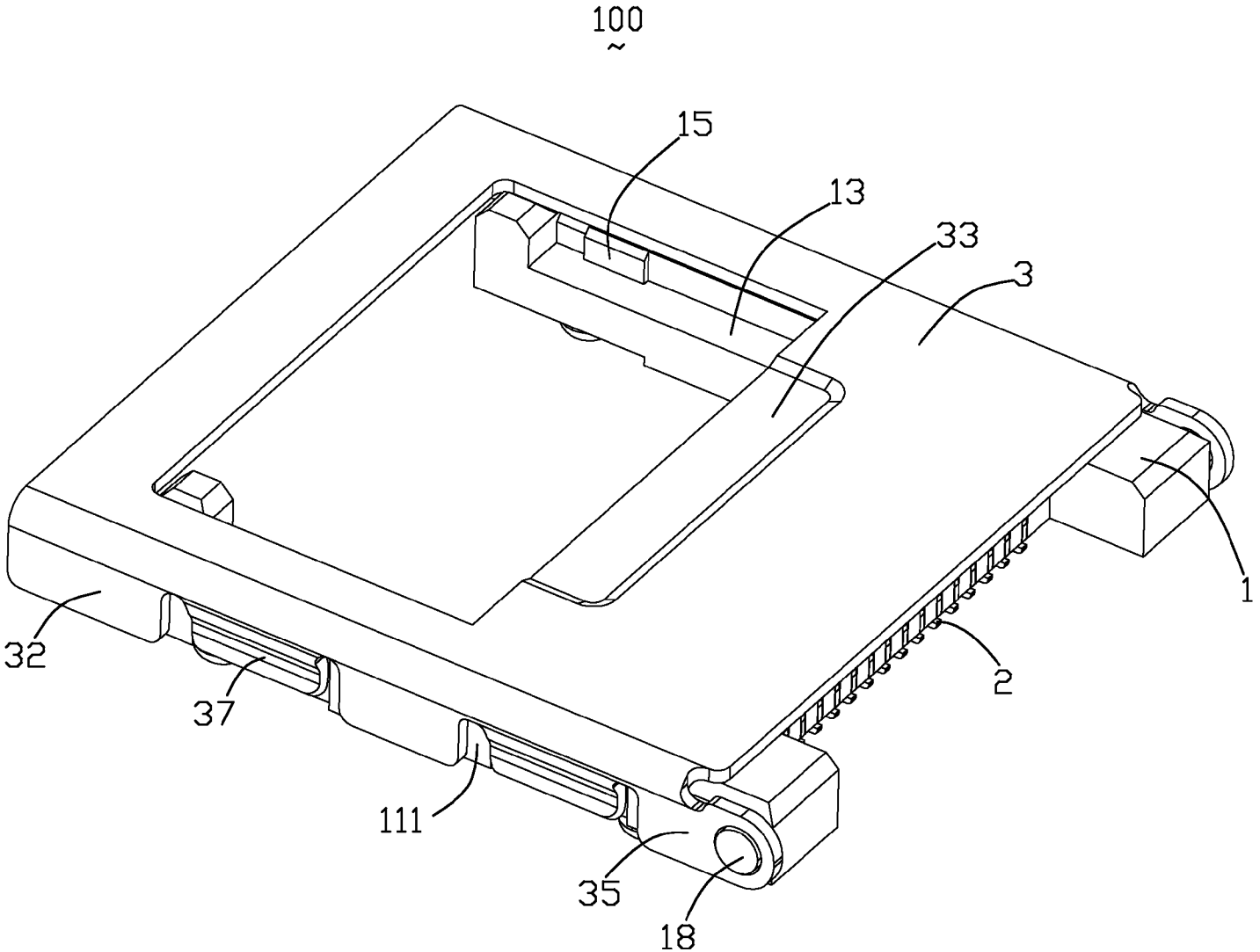
FIG. 1 is an assembled, perspective view of a socket in accordance with a preferred embodiment of present invention.

Reference will now be made in detail to the preferred embodiments of the present invention.

Referring to FIG.1 to FIG. 4, a socket 100 in accordance with a preferred embodiment of present invention is adapted for electrically connecting an IC package to a printed circuit board (not shown). The IC package is an optical ecosystem module 4 in present embodiment with a function transforming between optical signal and electronic signal. The socket 100 has an insulative housing 1, a plurality of contacts 2 received in the insulative housing 1 and a cover 3 pivotally assembled to an end of the insulative housing 1. The optical ecosystem module 4 is received in the insulative housing 1, and is formed with a plurality of pads (not shown) for conducting with the contacts 2. The cover 3 rotates between an open position and a close position, and presses the optical ecosystem module 4 within the insulative housing 1 in the close position.

Figure 2:
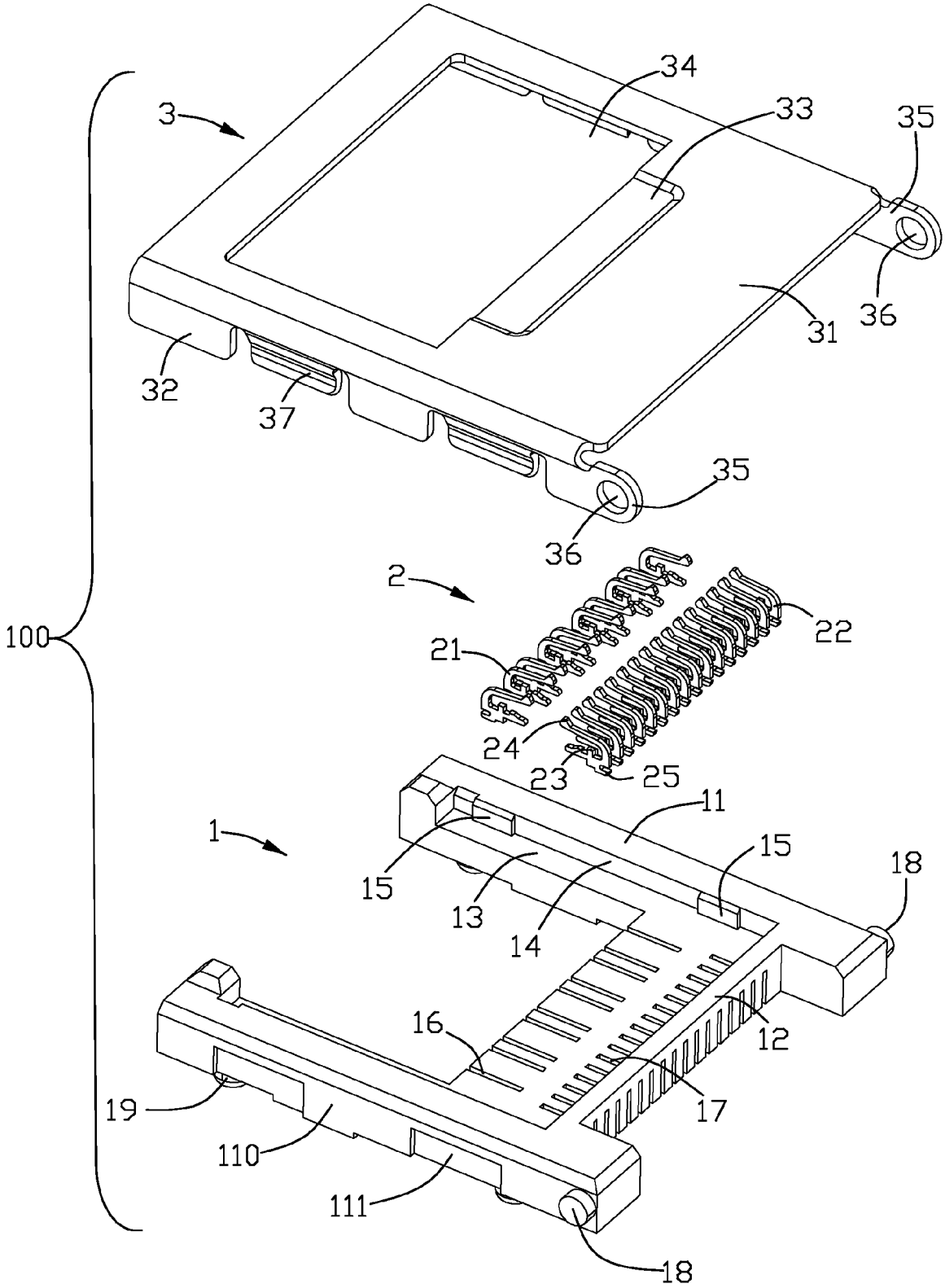
FIG. 2 is an explored, perspective view of the socket in accordance with the preferred embodiment of present invention.
Figure 3:
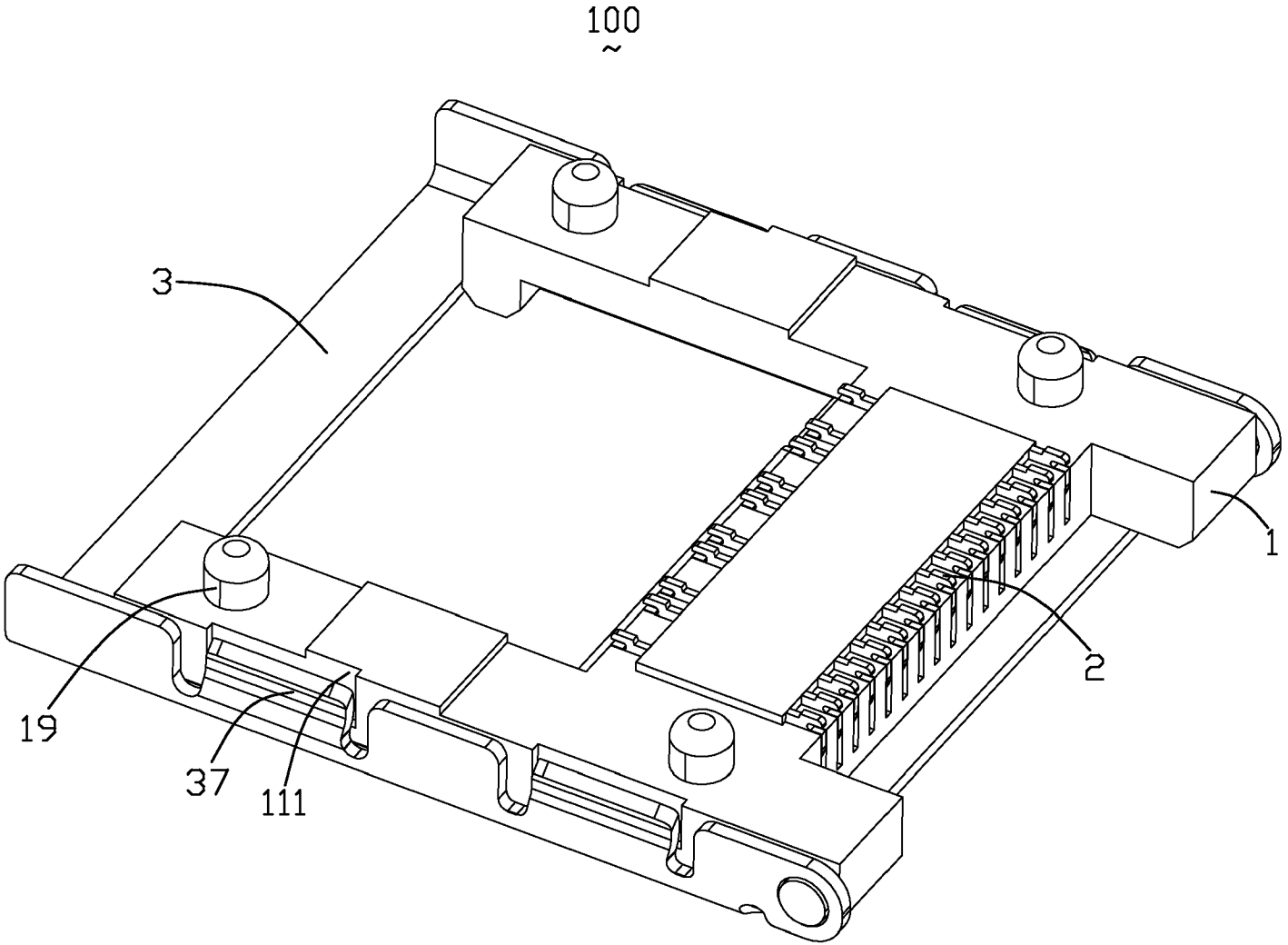
FIG. 3 is another assembled, perspective view of the socket.

Referring to FIG. 2, the insulative housing 1 has a plane shape, and includes a pair of lateral sides 11 and a base portion 12 disposed between the lateral sides 11 to make the insulative housing 1 have an H-shaped configuration. A rectangular receiving space 13 is recessed from top surfaces of the lateral sides 11 and the base portion 12 to receive the optical ecosystem module 4. The lateral side 11 is formed with two separated positioning clumps 15 on an inner sidewall 14 thereof near the receiving space 13. The base portion 12 defines two rows of passageways located below the receiving space 13: a front row of the passageways 16 and a rear row of passageways 17. The lateral side 11 has a vertical outside surface 110. A pivot 18 extends outwardly from the outside surface 110 and is disposed near the end of lateral side 11 where the cover 3 is pivotally assembled.

The lateral side 11 further has two separate incepting portions 111 recessed from the outside surface 110 to engage with the cover 3. The lateral side 11 has two pegs 19 extending downwardly from a bottom surface thereof and disposed on two opposite ends thereof for inserting into the printed circuit board (not shown) to position the insulative housing 1 on the printed circuit board (now shown).

The contacts 2 include a row of front contacts 21 and a row of rear contacts 22, arranged within the front row of passageways 16 and the rear row of passageways 17, respectively. The front contact 21 and the rear contact 22 have a same configuration and are disposed oppositely, each contact 2 has a retaining portion 23 disposed horizontally, an elastic portion 24 extending upwardly from an end of the retaining portion 23 and a tail 25 extending downwardly from the retaining portion 23. The retaining portion 23 fixes the contact 2 in the insulative housing 1, the elastic portion 24 and the tail 25 electrically connects the optical ecosystem module 4 and the printed circuit board (not shown), respectively.

The cover 3 pivotally assembled to the pivot 18 of the insulative housing 1 is stamped by cutting from a sheet metal and comprises a main body 31 in board-like shape and two sidewalls 32 extending downwardly from two opposite sides of the main body 31. The main body 31 has a pressing portion 33 and a quadrate opening 34 beside the pressing portion 33, the pressing portion 33 protrudes downwardly from a part of the main body 31 corresponding to the base portion 12 of the insulative housing 1. The sidewall 32 has a pivot portion 35 on an end thereof, and the pivot portion 35 defines a through hole 36 for the pivot 18 of the insulative housing 1 passing through. The sidewall 32 is formed with two fixing portions 37 corresponding to the incepting portions 111 of the insulative housing 1, the fixing portion 37 is bent inwardly from the sidewall 32 and has an arch configuration.

Figure 4:
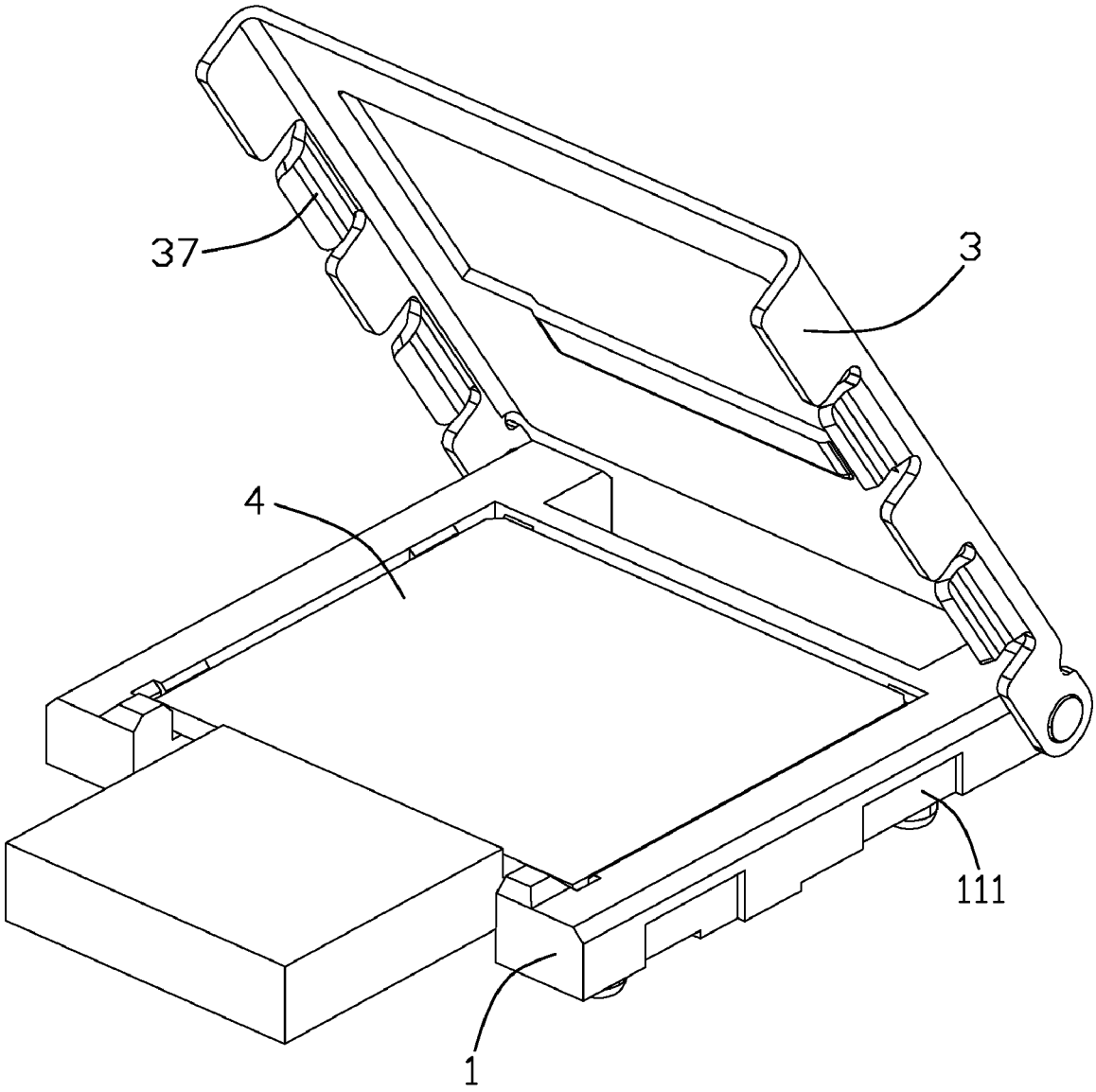
FIG. 4 shows the socket assembled with an optical ecosystem module.
Figure 5:
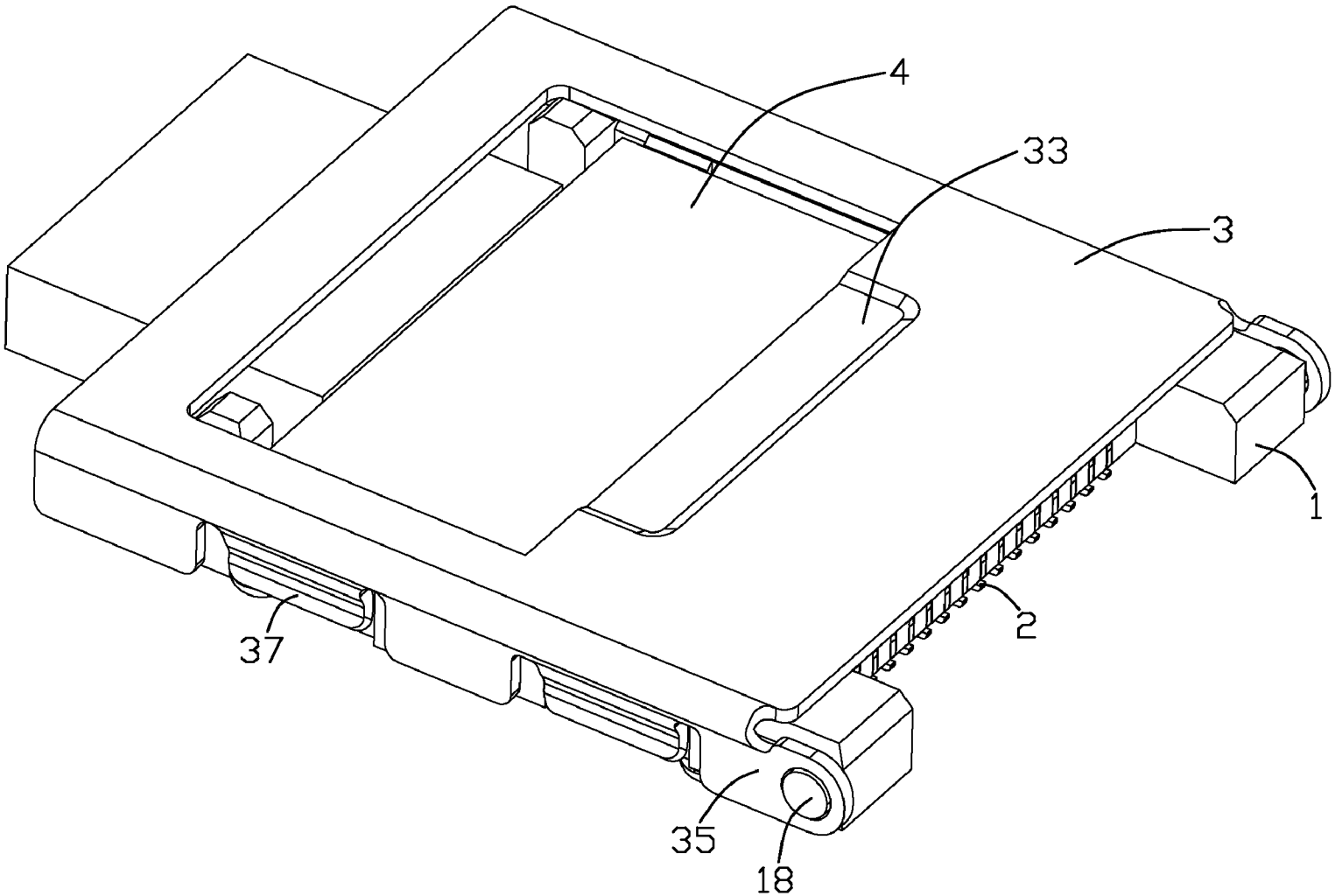
FIG. 5 is similar with FIG. 4, wherein a cover of the socket is in a close position.

Referring to FIG. 4 and FIG. 5, the contacts 2 are firstly assembled on the insulative housing 1; then the pivot portion 35 of the cover 3 rings the pivot 18 of the insulative housing 1 to completely assemble the socket 100, at this state, the cover 3 can rotate between the open position and the close position, and the optical ecosystem module 4 can mount in the receiving space 13 of the insulative housing 1. When the cover 3 is fixed to the insulative housing 1, the pressing portion 33 of the cover 3 presses a top surface of the optic ecosystem module 4 to make the optical ecosystem module 4 conduct with the contacts 2 in the insulative housing 1.

Each sidewall 32 of the cover 3 of the socket 100 has two fixing portions 37 on two end thereof for engaging with the corresponding incepting portions 111 of the insulative housing 1, and the fixing portions 37 are disposed on two sides of the pressing portion 33 of the cover 3, so even the pivot 18 is flayed heavy, the cover 3 still can tightly latch with the insulative housing 1 to prevent the cover 3 from tilting by a force exerted on the pressing portion 33 of the cover 3 by the optical ecosystem module 4, so the optical ecosystem module 4 can reliably connect with the printed circuit board (not shown).

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. A socket, for electrically connecting a module to a printed circuit board, comprising:

an insulative housing having a base portion and two lateral sides disposed on two sides of the base portion, each lateral side having at least two incepting portions recessed from a vertical outside surface of the lateral side;

a plurality of contacts received within the base portion of the insulative housing; and a cover pivotally assembled to the insulative housing and being rotatable between an open position and a closed position, the cover formed with a main body covering the insulating housing and a plurality of fixing portions disposed on two sides of the main body; wherein when the cover rotates downwardly to the closed position, the fixing portions of the cover directly latch with the inception portions of the insulative housing to latch the cover and the insulative housing together; and the fixing portion is bent inwardly to be an arch configuration and extends downwardly from the main body of the cover.

2. The socket as described in claim 1, wherein the insulative housing has two pivots extending outwardly, and the cover has two pivot portions each defining a through hole for the pivot passing through.

3. The socket as described in claim 1, wherein the cover is formed with a pressing portion extending downwardly from the main body for pressing the module toward the insulative housing.

4. The socket as described in claim 3, wherein the main body has an opening beside the pressing portion.

5. The socket as described in claim 1, wherein a receiving space is recessed from top surfaces of the base portion and the lateral sides and used for receiving the module.

6. The socket as described in claim 1, wherein each contact has a retaining portion disposed horizontally, an elastic portion extending upwardly from an end of the retaining portion and a tail extending downwardly from the retaining portion.

7. The socket as described in claim 1, wherein the lateral side is formed with two positioning clumps protruding into the receiving space.

8. A socket assembly, comprising:

an insulative housing, having a base portion and two lateral sides disposed on two sides of the base portion and defining a receiving space recessed from top surfaces of the base portion and the lateral portion, each lateral side having at least two incepting portions recessed from a vertical outside surface of the lateral side;

a plurality of contacts received within the base portion of the insulative housing;

a module mounted on the receiving space of the insulative housing; and a cover pivotally assembled to the insulative housing and being rotatable between an open position and a close position where the cover presses the module, the cover stamped by cutting from a sheet metal and comprising a horizontal main body in board-like shape, the cover formed with a plurality of fixing portions latching with the incepting portions of the insulative housing after the cover rotates to the close position, the fixing portion extending downwardly with a top side thereof connecting with the horizontal main body, and having a width substantially same as that of the incepting portion of the insulative housing.

9. The socket assembly as described in claim 8, wherein the fixing portion is flexible only in a vertical plane.

10. The socket assembly as described in claim 9, wherein the fixing portions are bent inwardly to be an arch configuration and extend downwardly from two sides of the cover.

11. The socket assembly as described in claim 10, wherein a receiving space is recessed from top surfaces of the base portion and the lateral sides and used for receiving the module.

12. The socket assembly as described in claim 10, wherein each contact has a retaining portion disposed horizontally, an elastic portion extending upwardly from an end of the retaining portion and a tail extending downwardly from the retaining portion.

13. A socket assembly comprising:

an insulative housing including a main body with two side arms extending at two opposite longitudinal ends of said main body along a front-to-back direction, said housing further defining upper and lower levels in a vertical direction perpendicular to said front-to-back direction;

a mating face formed on an upward face of the main body;

a plurality of contacts disposed in the main body with contacting sections upwardly extending above the mating face;

a cutout formed among the main body and two side arms and defining a large width in a transverse direction, which is perpendicular to both said front-to-back direction and said vertical direction, at said upper level, and a small width in said transverse direction at said lower level; wherein a laterally extending stopper is formed at a front end of at least one of said side arms to narrow said large width so that a media module, which defines on an upper half thereof a similar dimension as the large width, is downwardly assembled into said cutout with a downward mating surface confronting the mating face under condition that said media module is confined among the main body, the pair of side arms and the stopper without horizontal movement in both said front-to-back direction and said transverse direction, and a cover is pivotally mounted upon the housing to shield said media module for preventing upward withdrawal of said media module from the cutout of the housing, wherein said cover defines a window to expose the media module thereunder and the stopper extends upwardly to enter the window.

14. The socket assembly as claimed in claim 13, wherein an interengaging device is formed on both said cover and said housing to result in retention therebetween in the vertical direction.

15. The socket assembly as claimed in claim 13, wherein each of said side arms defines a step structure to comply with said large width at the upper level and the small width at the lower level.

16. The socket assembly as claimed in claim 13, wherein said media module occupies said cutout at both said upper level and said lower level.

17. The socket assembly as claimed in claim 13, wherein said cover defines a transverse bar at a front end thereof to isolate said window from an exterior in said front-to-back direction, and said stopper forwardly engages said transverse bar.

* * * * *